United States Patent [19]

Belvederi et al.

[11] Patent Number: 4,716,909

[45] Date of Patent: Jan. 5, 1988

[54] PAPER STRIP GUIDE DEVICE, FOR A CIGARETTE MAKING MACHINE

[75] Inventors: Bruno Belvederi, San Martino di Monte San Pietro; Armando Neri, Bologna, both of Italy

[73] Assignee: G.D. Societa per Azioni, Bologna, Italy

[21] Appl. No.: 836,291

[22] Filed: Mar. 5, 1986

[30] Foreign Application Priority Data

Mar. 19, 1985 [IT] Italy ..... 3370 A/85

[51] Int. Cl.[4] ..... A24C 5/14; A24C 5/20

[52] U.S. Cl. ..... 131/84.1; 131/60

[58] Field of Search ..... 131/84.1, 84.3, 84.4, 131/60–69

[56] References Cited

U.S. PATENT DOCUMENTS 4,336,813 6/1982 Seragnoli ..... 131/60
4,444,209 4/1984 Seragnoli ..... 131/60
4,583,557 4/1986 Mattei et al. ..... 131/84.1
4,589,426 5/1986 Mattei ..... 131/84.4

*Primary Examiner*—V. Millin
*Assistant Examiner*—H. Macey
*Attorney, Agent, or Firm*—Karl F. Ross; Herbert Dubno

[57] ABSTRACT

In a strip guide device for the automatic feed of a strip of paper (8) along a bench (1) for the formation of a continuous cigarette roll, the bench (1) is bounded at the top by a belt (4) which has above it a supply device (9) for a continuous carpet (10) of tobacco, and the sstrip guide device comprises a suction pulley (5) at the upper branch (3) and an idler wheel (22) for the return of the strip of paper (8) above the bench (1). The idler return wheel (22) mounted on a rotational axle (23) which moves along a predetermined path between a position in which it is substantially tangential to the plane in which the bench (1) lies, and a position which is disengaged with respect to this plane and is assumed by the roller (22) in the case of breakage of the strip (8).

4 Claims, 1 Drawing Figure

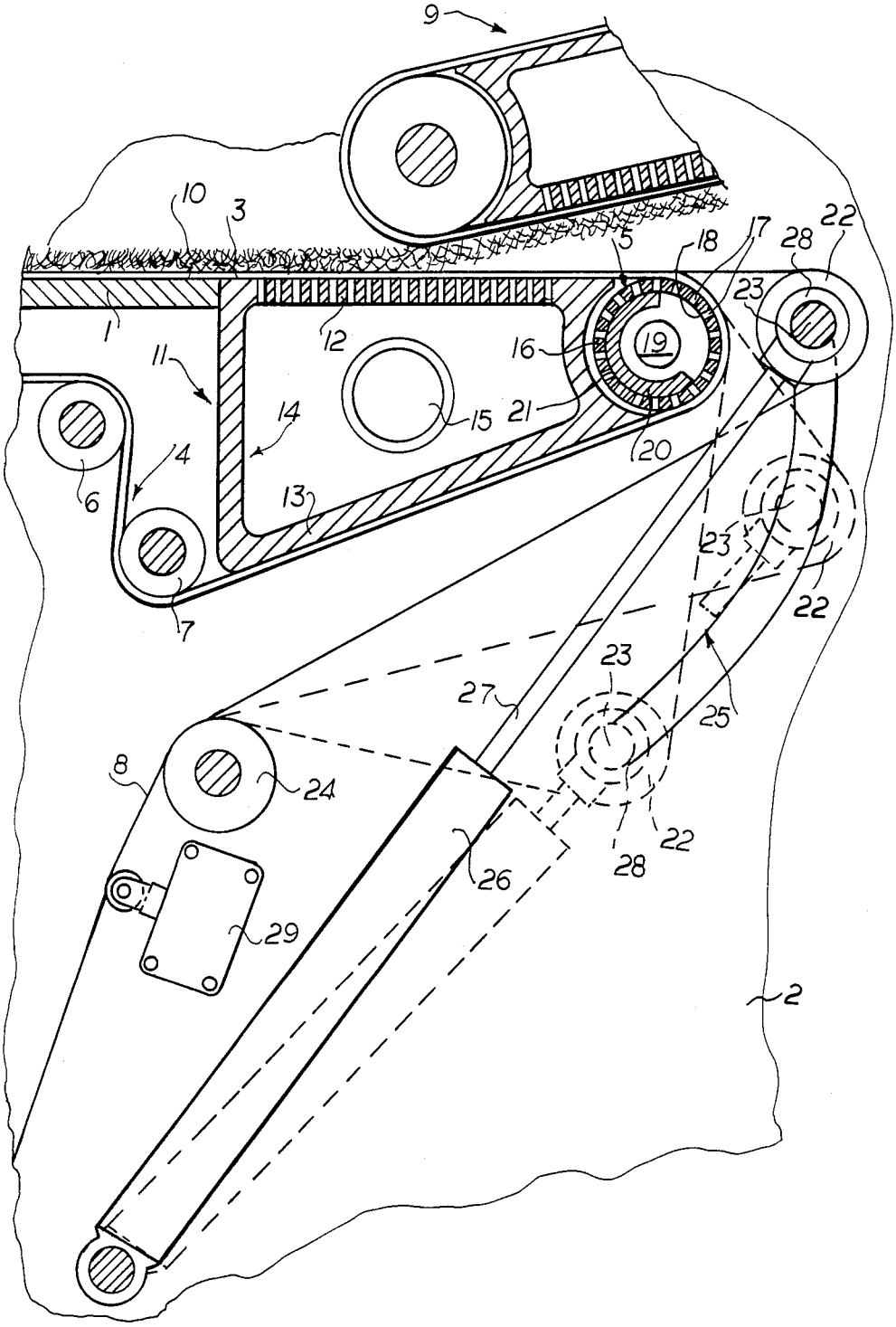
9
10
3
5
18
17
28
22
23
1
12
16
19
11
14
15
21
20
4
6
13
7
23
22
23
27
25
8
24
22
28
26
29
2

PAPER STRIP GUIDE DEVICE, FOR A CIGARETTE MAKING MACHINE

FIELD OF THE INVENTION

The present invention relates to a strip guide device, particularly for a cigarette making machine.

BACKGROUND OF THE INVENTION

In accordance with the prior art, cigarette packaging machines normally comprise a supply unit within which a paper strip unwound from a spool is supplied via a plurality of operating units to a deflection pulley about which the strip is wound and then continues its path above the horizontal bench.

The upper branch of a belt, normally of textile, air-permeable, material and of a closed circuit type, is interposed between the bench and the paper strip.

In the vicinity of this deflection pulley, the strip of paper which is moved along the horizontal bench together with the belt of textile material, receives a continuous carpet of cut tobacco from above.

During its travel along the bench, the paper strip is forced by the belt to fold progressively in a transverse direction so as to form a continuous cylinder full of tobacco, commonly called a continuous cigarette roll, from which the individual cigarettes are obtained by a cutting operation.

When, during the operation of the machine, the paper strip breaks upstream of the deflection pulley, a sensor, normally provided along the path of the strip, automatically shuts down operation of the packaging machine, thus enabling an operator to take the necessary action.

One of the most difficult operations which the operator must carry out to re-activate the packaging machine is to rewind the paper strip about the deflection pulley and to thread it through the very narrow space between the bench and the end of a conveyor for the carpet of tobacco.

An operation of this type, which is difficult to carry out on a machine having a single cigarette roll, becomes almost impossible when it has to be carried out on a machine having a double cigarette roll, or which is able to produce two cigarette rolls simultaneously.

In effect, in this latter case, there are two paper strips which have to be wound around respective coaxial pulleys disposed at the inlet of the bench for the formation of the rolls. As a result of this, one of these pulleys is completely covered by the other and makes access impossible for the operator.

In the U.S. Pat. No. 4,336,813 in the name of the applicants the insertion of the paper strip into the bench for the formation of the roll is automated in an attempt to solve this problem.

In accordance with this patent, cylindrical surface of the deflection pulley placed at the inlet of the bench for the formation of the roll is connected to a suction source.

The operator, therefore, simply has to bring the head of each paper strip into the vicinity of the return pulley, which takes up the strip contacting its outer surface by suction, and, after rotating, feeds the strip to the bench for the formation of the roll.

In an embodiment of the device described in U.S. Pat. No. 4,336,813, the pulley which may be connected to a suction source, forms a return means for the paper strip and also the belt of textile material supporting the paper strip on the bench for the formation of the roll.

It has, however, been found that in these conditions the paper strip does not obey, as a result of its adhesion to the textile material belt in the curved section formed by the deflection pulley, any commands for transverse displacement with which it is supplied by a deflection device controlled by a control device.

In a second embodiment of the device set out in U.S. Pat. No. 4,336,813, the paper strip and the textile material belt are inserted on the roll formation bench by winding about two different return rollers, with the result that the paper strip is superimposed on the belt after the latter has been inserted on the horizontal bench surface.

With respect to the first embodiment, this embodiment has the advantage of a paper strip which is extremely sensitive to transverse displacement commands, but makes it necessary to provide a fixed horizontal bridge, interposed between the two return rollers, which is designed, after each shutdown of operation, to support and guide the head of the paper strip moved by the suction return roller until it is superimposed on the strip of textile material.

The second embodiment has not proved particularly reliable either, since the fixed bridge may cause blocking or folding of the head of the strip as a result of friction with consequent interruptions in its supply.

OBJECT AND SUMMARY OF THE INVENTION

The object of this invention is to provide a strip guide device of automatic type which is able to overcome the drawbacks described above with reference to the prior art, i.e. a device in which the paper strip is extremely sensitive to any transverse displacement command and may be inserted, each time the packaging machine is started, on the roll formation bench without any risk of obstruction.

This object is solved by the present invention, in that the invention relates to a strip guide device particularly for a cigarette making machine, for the automatic feed of at least one paper strip along a horizontal bench for the formation of at least one continuous cigarette roll, the bench being bounded at the top by the upper branch of at least one air-permeable belt which has above it a device for the supply of a continuous carpet of tobacco, the said strip guide device comprising a suction pulley at the end of the upper branch and an idler wheel for the return of the paper strip above the bench, characterised in that the idler return wheel is mounted on a rotational axle which may be moved along a predetermined path between a position in which the idler wheel is substantially tangential to the plane in which the bench lies and a position which is disengaged with respect to this plane.

DESCRIPTION OF THE DRAWING

The invention will now be described with reference to the attached drawing which shows an axial section through a preferred embodiment of the strip guide device in question, purely by way of non-limiting example.

DETAILED DESCRIPTION OF THE DRAWING

This FIGURE shows the inlet end of a bench 1 for the formation of a continuous cigarette roll of a cigarette making machine. The bench 1 is fixed in a substantially horizontal position to a front wall 2 of the machine and supports in a sliding manner the upper branch 3 of a conveyor belt 4 made of air-permeable material.

The belt 4, of the closed circuit type, is wound, at the inlet end of the bench 1, about a pulley 5 having a horizontal axis, and is kept tensioned by return rollers 6 and 7.

The upper branch 3 of the belt 4 is designed to cause the supply of a paper strip 8 to move along the upper surface of the bench 1, a carpet 10 of cut tobacco being supplied thereabove by a supply device of known type, shown overall by 9.

The strip guide device in question comprises a box 11 adjacent to the pulley 5 and bounded at the top by a horizontal perforated wall 12 disposed in contact with the upper branch 3 of the belt 4 and at the base by an inclined wall 13 disposed in contact with the section of the belt 4 between the roller 7 and the pulley 5.

Inside the box 11, there is formed a chamber 14 communicating with a suction source (not shown) via a conduit 15.

The pulley 5, formed by a tube 16 having a plurality of uniformly distributed radial holes 17, is rotatably supported by the wall 2 of the machine and rotates, under the action of actuation means (not shown), about its axis. The tube 16 defines a cylindrical chamber 18 communicating, on one side, with atmosphere via the holes 17 and, on the other side, with a suction device (not shown) communicating with the interior of this chamber 18 via an axial conduit 19.

A screen element 20, bounded externally by a surface 21 having a cylindrical course and extending substantially through an angle of 180°, is housed in a fixed position within the chamber 18. The surface 21 is disposed coaxially to the pulley 5 and cooperates in a leak-tight manner with the half of the inner cylindrical surface of the tube 16 facing towards the box 11.

A return roller for the strip 8 is shown by 22 and is mounted in a rotary manner on an axle 23 parallel to the axis of the pulley 5, and is substantially tangential to the plane in which the branch 3 of the belt 4 lies.

Below the box 11, there are provided fixed return means comprising a second return roller 24, mounted on an axle parallel to the axis 23.

The axle 23 passes through the upper end of an arcuate eye 25 provided in the wall 2.

An actuator, pivoted at its base on a pin perpendicular to the wall 2 and provided with an axially movable output shaft 27 connected to the axle 23 by a sleeve 28, is shown by 26.

As a result of the connection described above, when the shaft 27 is retracted by the actuator 26, the roller 22 slides along the path defined by the eye 25 from an upper position in which the roller 22 is shown by a continuous line in the FIGURE to a lower position in which the roller 22 is shown by a dashed line.

In normal operating conditions of the packaging machine, the paper strip 8, unwound from a spool (not shown), and passing above the roller 24 and around the roller 22 disposed in the upper position, slides, in contact with the upper branch 3 of the belt 4, along the roll formation bench. The supply device 9 pours a continuous carpet of tobacco 10 onto the strip 8 for the formation, in a known manner, of a continuous cigarette roll.

If the paper strip 8 breaks, detection means 29 of known type which are sensitive to variations in the tension of the strip 8 causes the shutdown of the packaging machine and actuate the actuator 26 which retracts the shaft 27 causing the roller 22 to slide towards the lower position.

At this point, an operator disposes the strip 8 along the path bounded by the return rollers 24 and 22 so as to bring its head into contact with the surface of the pulley 5 which is caused to communicate with the suction device and, meanwhile, receives a command to rotate at a lower speed. The end of the strip 8, brought into contact with the outer surface of the pulley 5, is then supplied above the belt 4.

The supply device 9 then starts again to supply the strip 8 with the carpet of tobacco, and the machine returns to normal operation.

Once this condition is achieved, the means 29 for detecting the tension of the strip 8 supplies a control signal to the actuator 26, causing the roller 22 to project from its shaft 27 and slide from the lower position to the upper position which is substantially tangential to the plane in which the roll is formed.

The shape of the eye 25 may be such that it does not cause substantial tension variations in the section of the strip 8 between the roller 24 and the pulley 5. In other words, during the displacement of the roller 22 between the lower and upper positions, the length of the section of the strip 8 between the generatrices along which the strip 8 is in contact with the roller 24 and the pulley 5 respectively, should be maintained substantially constant when the roller 22 is in the said upper position.

It is evident from the above that the strip guide device in question enables the automatic insertion of the strip of paper 8 onto the roll formation bench without the risk of drawbacks, since the head of the paper strip 8 is disposed in direct contact with the section of the belt 4 wound around the suction pulley 5.

In effect, in the strip guide device in question, the roller 22, in this insertion state, is in a disengaged condition with respect to the roll formation plane, and consequently, there is no need for the fixed connection bridge between the roller 22 and the pulley 5, which constitutes, as mentioned above, the main cause of jamming of the strip 8.

In normal operating conditions of the packaging machine, the presence of the roller 22 in the upper position, preventing the paper strip 8 from adhering to the section of the belt 4 wound around the pulley 5, makes it easy to correct the transverse position of the strip 8 by deflection means of known type disposed upstream of the roller 24.

The above description made with reference to a machine with a single cigarette roll naturally also applies to a machine with a double cigarette roll. The strip guide device of the present invention is particularly suitable for use in a machine of the type having a double cigarette roll, in which the drawbacks described above are particularly serious.

In this latter case, the two strips of paper may wind around a single return roller 22 mounted on the axle 23 or alternatively around respective adjacent return rollers.

We claim:

1. A strip guide device, particularly for a cigarette making machine, for the automatic feed of at least one paper strip to form at least one continuous cigarette roll, said device comprising:

at least one air-permeable belt, each belt having an upper branch;

a horizontal bench being bounded at a top thereof by said upper branch;

a device for supply of a continuous carpet of tobacco;

a suction pulley at an end of said upper branch and tangential to said top of said bench;

an idler wheel for return of the paper strip above the bench and mounted on a rotational axle, said idler wheel being adjacent said suction pulley; and means for moving said rotational axle along a predetermined path between a position in which the idler wheel is substantially tangential to the plane in which the bench lies and a position which is disengaged with respect to this plane.

2. A device according to claim 1 further comprising a fixed return means and wherein the predetermined path is such as to define a path, between the pulley and the fixed return means, for the strip, whose length is substantially constant irrespective of the position of the idler wheel.

3. A device according to claim 1 wherein the predetermined path is shaped substantially as an elliptical arc.

4. A device according to claim 1 further comprising means for detecting breakages of the strip for controlling actuator means for the translation of the idler wheel from the position tangential to the plane in which the bench lies to the disengaged position.

* * * * *